United States Patent [19]

Timmons et al.

[11] Patent Number: 4,794,737

[45] Date of Patent: Jan. 3, 1989

[54] UNIVERSAL BACKING FLANGE

[75] Inventors: Russell M. Timmons, Lutherville; Robert W. Bailey, Parkton, both of Md.

[73] Assignee: Black & Decker Inc., Newark, Del.

[21] Appl. No.: 22,889

[22] Filed: Mar. 6, 1987

[51] Int. Cl.[4] ..... B24B 23/00; B24D 9/08

[52] U.S. Cl. ..... 51/168; 51/378

[58] Field of Search ..... 51/168, 170 T, 209 R, 51/358, 376, 377, 378, 382, 383, 384, 385, 386, 389; 411/544, 545, 547

[56] References Cited

U.S. PATENT DOCUMENTS

| | | | |
|---|---|---|---|
| 1,481,515 | 1/1924 | Kraft | 411/545 |
| 1,724,742 | 8/1929 | Albertson et al. . | |
| 2,278,301 | 3/1942 | Bauer . | |
| 3,041,797 | 7/1962 | Moffly . | |
| 3,136,100 | 6/1964 | Robertson, Jr. . | |
| 3,166,877 | 1/1965 | Reames . | |
| 3,500,592 | 3/1970 | Harrist . | |
| 3,528,203 | 9/1970 | Franklin et al. . | |
| 3,596,415 | 8/1971 | Donahue, Jr. | 51/378 |
| 3,879,178 | 4/1975 | Bosma . | |
| 3,912,411 | 10/1975 | Moffat . | |
| 4,015,371 | 4/1977 | Grayston . | |
| 4,449,329 | 5/1984 | Sauerwein et al. | 51/168 |
| 4,655,006 | 4/1987 | Block | 51/168 |
| 4,694,615 | 9/1987 | MacKay, Jr. | 51/209 R X |

*Primary Examiner*—Robert P. Olszewski

*Attorney, Agent, or Firm*—Harness, Dickey & Pierce

[57] ABSTRACT

A coupling flange for use on a power tool such as a portable grinder for transferring torque loads from the motor-driven spindle of the tool to a tool element subassembly such as an abrasive disc subassembly. The coupling flange is designed to accommodate and be usable with both hubbed and non-hubbed abrasive disc subassemblies. The coupling flange is adapted to be installed onto the spindle of the tool and comprises a first contact surface for frictionally engaging the spindle, and at least two radially spaced annular drive surfaces. The first drive surface is adapted to frictionally engage the backing flange of a hubbed-type of abrasive disc subassembly and the second drive surface is adapted to frictionally engage the backside of the abrasive disc of a non-hubbed type of abrasive disc subassembly.

22 Claims, 3 Drawing Sheets

UNIVERSAL BACKING FLANGE

BACKGROUND AND SUMMARY OF THE INVENTION

The present invention relates to an improved system for mounting a tool element subassembly to the output spindle of a power tool and more particularly to a coupling flange that is adapted to accommodate and drivingly engage both hubbed and non-hubbed types of abrasive disc subassemblies which may be mounted to the spindle of a portable grinder.

The abrasive disc subassembly used on portable grinders generally consists of an abrasive disc that is carried by an internally threaded collar. The collar is adapted to be mounted to the externally threaded spindle of the grinder. Typically, the direction of rotation of spindle when the motor in the grinder is energized is such that the collar will self-thread onto the spindle and bear against an annular shoulder formed on the spindle. Alternatively, it has been proposed to provide an annular composite "soft" washer assembly between the collar on the abrasive disc subassembly and the annular shoulder on the spindle to prevent the collar from becoming locked or jammed against the annular shoulder of the subassembly. This latter type of mounting construction is described in U.S. Pat. No. 4,449,329, issued May 22, 1984, for a "Composite Washer Assembly", and assigned to the assignee of the present invention. A further type of mounting construction employs a supporting flange member that is positioned against the annular shoulder of the spindle and at its radial distal end supports and rotationally drives the abrasive disc.

In addition, a new mounting assembly for hubbed abrasive disc subassemblies has recently been proposed that comprises an abrasive disc having permanently attached to its backside a first metal backing flange or "hub". A second base flange member is positioned on the spindle of the grinder against the annular shoulder of the spindle. The base flange member has a pair of radially spaced annular drive surfaces on one side that are adapted to engage corresponding radially spaced raised annular contact surfaces on the backing flange or hub of the abrasive disc subassembly. The other side of the base flange member is adapted to engage and be driven by the annular shoulder on the spindle of the grinder or by a "soft" washer assembly of the aforementioned type disposed between the base flange member and the annular shoulder of the spindle.

Although this latter two-component system for driving grinding wheels provides operational advantages over the previously employed systems, it possesses the disadvantage of being incompatible with prior designed non-hub-type abrasive disc subassemblies, which are most commonly available. Specifically, a portable grinder equipped with the base flange member of the aforementioned two-component system will not drive a conventionally designed abrasive disc subassembly not having the proper backing flange. Rather, in order to use a conventional non-hub abrasive disc subassembly, the base flange member must first be removed from the spindle of the grinder and replaced with a conventional support flange member. This, of course, is undesirable not only from a convenience standpoint, but also because the base flange member, once removed, is likely to be lost or misplaced, particularly in a commercial environment where portable grinders are most frequently used.

Accordingly, it is the primary object of the present invention to provide an improved drive system for mounting a tool element and, in particular, an abrasive disc subassembly, to the output spindle of a power tool such as a portable grinder.

In addition, it is an object of the present invention to provide an improved mounting and drive assembly that is completely compatible with the abrasive disc subassemblies for the newer two-component mounting system as well as with the conventionally designed non-hub-type abrasive disc subassemblies.

BRIEF DESCRIPTION OF THE DRAWINGS

Additional objects and advantages of the present invention will become apparent froma reading of the Detailed Description of the Preferred Embodiments which make reference to the following set of drawings in which.

DETAILED DESCRIPTION OF THE PREFERRED EMBODIMENTS

Figure 1:
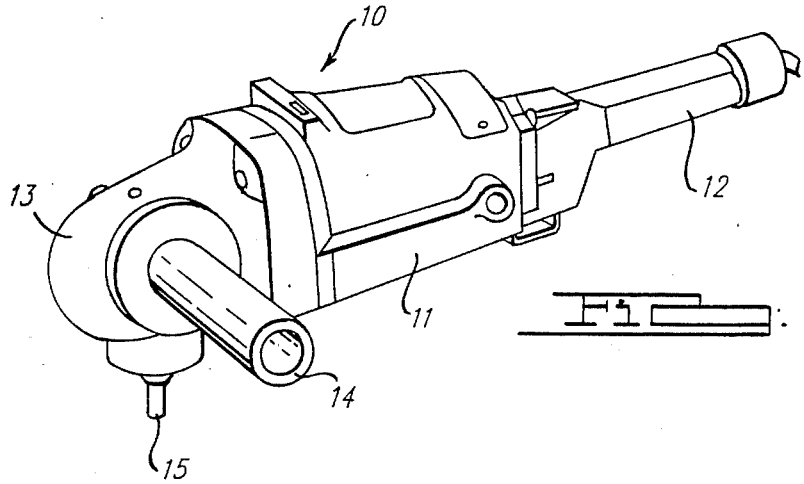
FIG. 1 is a perspective view of a typical power tool to which the teachings of the present invention may be applied.

With reference to FIG. 1, there is illustrated a portable electric grinder 10 with which the teachings of the present invention may be applied. It will be appreciated by those skilled in the art, however, that the grinder 10 is only exemplary of a wide variety of power tools and other devices to which the invention may be applied. With this in mind, the grinder 10 generally comprises a motor housing 11, a switch handle 12, a gear case 13, an auxiliary handle 14, and a right-angle spindle 15 for mounting a grinding wheel subassembly or other tool element subassembly. The guard for the grinder has been removed in FIG. 1 for the sake of clarity. With further reference to FIGS. 2–7, the spindle 15 is externally threaded and has an annular shoulder 16 formed thereon. A tool element subassembly, or abrasive disc subassembly 17, is threadably mounted on the spindle 15. The abrasive disc subassembly 17 includes a depressed center abrasive disc 18 carried by an internally-threaded collar 19. It should be noted at this point that while the preferred embodiments of the present invention are described and illustrated herein in combination with depressed center abrasive disc subassemblies, the present invention is equally applicable to flat "type 1" abrasive disc subassemblies.

Figure 2:
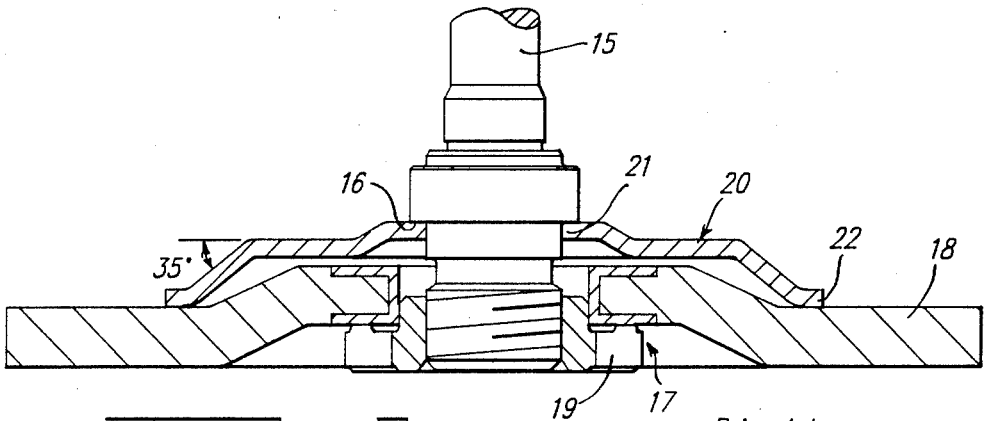
FIG. 2. Prior Art
FIG. 2 is an elevational sectional detail view of the right-angle spindle of the tool shown in FIG. 1, showing a first prior art mounting and drive assembly.

With particular reference to FIG. 2, a first prior art mounting construction is shown. The abrasive disc subassembly 17 in this construction is supported by a flange member 20 that is positioned on the spindle 15 of the grinder so that the central portion 21 of the flange abuts the annular shoulder 16 of the spindle 15. In addition, the flange member 20 is typically configured so that the outer distal end portion 22 supports the backside of the abrasive disc 18 radially outward of the depressed center portion of the abrasive disc as shown. Thus, due to the direction of rotation of the spindle 15 relative to the threads on the spindle, when the motor in the grinder is energized, the collar 19 of the abrasive disc subassembly 17 will self-thread onto the spindle 15 so that the abrasive disc 18 bears against the distal end portion 22 of support flange 20. Support flange 20 thus provides a drive coupling between the spindle 15 of the grinder and the abrasive disc 18.

Figure 3:
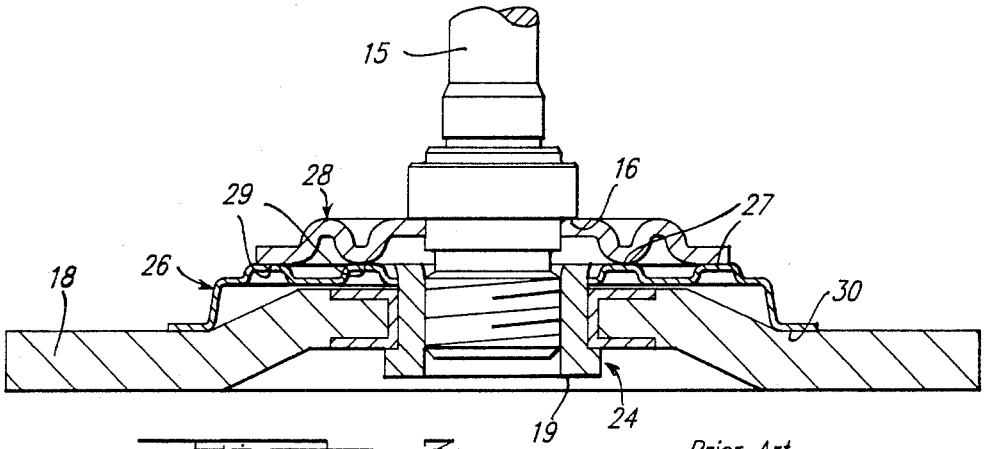
FIG. 3. Prior Art
FIG. 3 is an elevational sectional detail view of the right-angle spindle of the tool shown in FIG. 1, showing a second prior art mounting and drive assembly.

Referring to FIG. 3, an additional prior art mounting assembly for a "hubbed"-type grinding wheel is shown. In the construction illustrated in FIG. 3, the abrasive disc subassembly 24 comprises a depressed center abrasive disc 18 that is permanently affixed to an internally threaded collar 19 adapted to be threaded onto the end of the spindle 15. In addition, the abrasive disc subassembly 24 includes a flexible metal backing flange 26 that is also permanently attached to the backside of the abrasive disc 18 and thus comprises part of the subassembly 24 that is disposed of when the abrasive disc 18 is worn out. The backing flange 26 includes a pair of raised or elevated, radially spaced annular contact surfaces 27 and an annular drive surface 30 at its outer distal end that drivingly engages and supports the backside of the abrasive disc 18 radially outward of the depressed center portion of the abrasive disc 18. A second base flange member 28 is provided that is adapted to be positioned against the shoulder 16 of the spindle 15 and is configured to drivingly engage the backing flange 26. In particular, the base flange member 28 includes a pair of radially spaced annular drive surfaces 29 that are adapted to drivingly engage the correspondingly radially spaced annular contact surfaces 27 on the backing flange 26 of the abrasive disc subassembly 24. In this manner, the rotational force from the spindle 15 is transferred to the abrasive disc subassembly 24 via the frictional interface between the driving surfaces 29 on the base flange member 28 and the raised contact surfaces 27 on the backing flange member 26. This rotational force is in turn applied directly to the abrasive disc 18 via the frictional interface between the abrasive disc 18 and the distal end drive surface 30 of the backing flange 26.

Significantly, it will be appreciated that the two-component mounting system illustrated in FIG. 3 provides a self-tightening feature as the grinder is operated. In particular, in the unloaded condition, due to the relatively small point contacts between the drive surfaces 29 on the base flange member 28 and the contact surfaces 27 on the backing flange 26, the degree of friction between the two flange members is relatively low. Therefore, when the abrasive disc 18 is initially loaded and the subassembly 24 begins to slip relative to spindle 15, the abrasive disc subassembly 24 will immediately thread more tightly onto the spindle 15. This in turn will cause the backing flange 26 to flex and bear more tightly against the drive surfaces 29 of the base flange member 28, thereby increasing the coefficient of friction between the two flange members 26 and 28 and preventing further slippage between the abrasive disc 18 and the spindle 15 from occurring.

The prior art two-component mounting system illustrated in FIG. 3, however, suffers the disadvantage of being incompatible with the non-hubbed abrasive disc assemblies 17 of the type illustrated in FIG. 2. This disadvantage is particularly evident in commercial environments where grinders are most commonly used and abrasive disc subassemblies are frequently worn out and replaced. It is not uncommon for the supply of replacement grinding wheel subassemblies at a given job site to comprise a collection of both hubbed and non-hubbed types. Thus, it is inconvenient and time consuming for an operator on the job site faced with having to replace a worn hubbed wheel subassembly to disassemble and replace the drive assembly in order to install an unhubbed wheel subassembly. Accordingly, it can be appreciated that it is desirable to provide a mounting and drive assembly that is compatible with both types of abrasive disc subassemblies.

The present invention solves this problem by providing a universal coupling flange member that is compatible with both the non-hubbed abrasive disc subassembly 17 of the type illustrated in FIG. 2, as well as the hubbed-type of abrasive disc subassembly 24 illustrated in FIG. 3. Specifically, and with particular reference to FIG. 4, the coupling flange 35 according to the present invention is preferably formed from stamped metal and is adapted to be positioned on the spindle 15 so that the central contact surface 44 of the flange abuts the annular shoulder 16 of the spindle 15. The flange 35 is configured to provide three separate drive surfaces 36, 37, and 38. When used in combination with a non-hubbed abrasive disc subassembly 17 of the type illustrated in FIG. 2, the drive surface 38 at the distal end of the flange 35 is adapted to drivingly engage and support the backside of the abrasive flange 18 in the same manner as the flange 20 in the prior art construction. Significantly, it will be noted that the distance "h1" in the axial direction between the drive surface 38 and the driving surfaces 36 and 37 is such that in the embodiment illustrated in FIG. 4, the drive surfaces 36 and 37 of flange member 35 do not contact the backside of the abrasive disc 18. Accordingly, the driving force of the spindle 15 is transferred by the coupling flange member 35 to the abrasive disc subassembly 17 solely via the frictional engagement between the radially outer distal end drive surface 38 of the coupling flange 35 and the abrasive disc 18.

Figure 4:
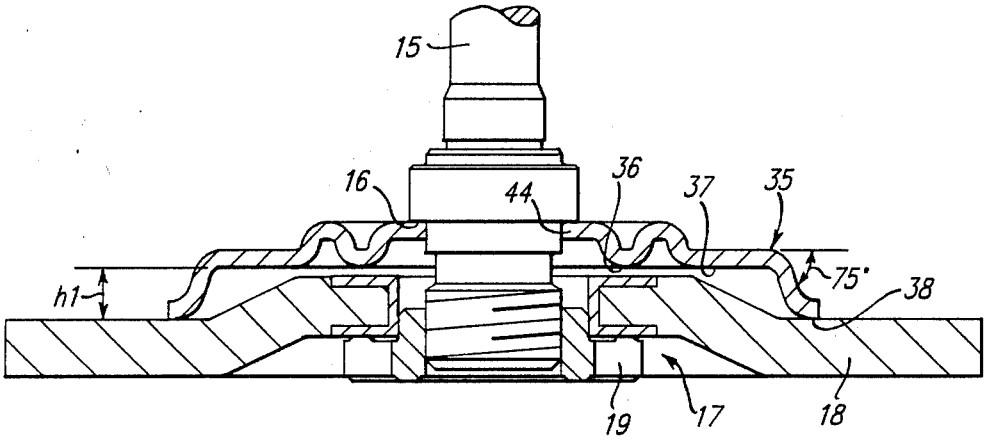
FIG. 4 is an elevational sectional detail view of the right-angle spindle of the tool shown in FIG. 1, showing a mounting and drive assembly according to the present invention when used with the abrasive disc subassembly illustrated in FIG. 2.
Figure 5:
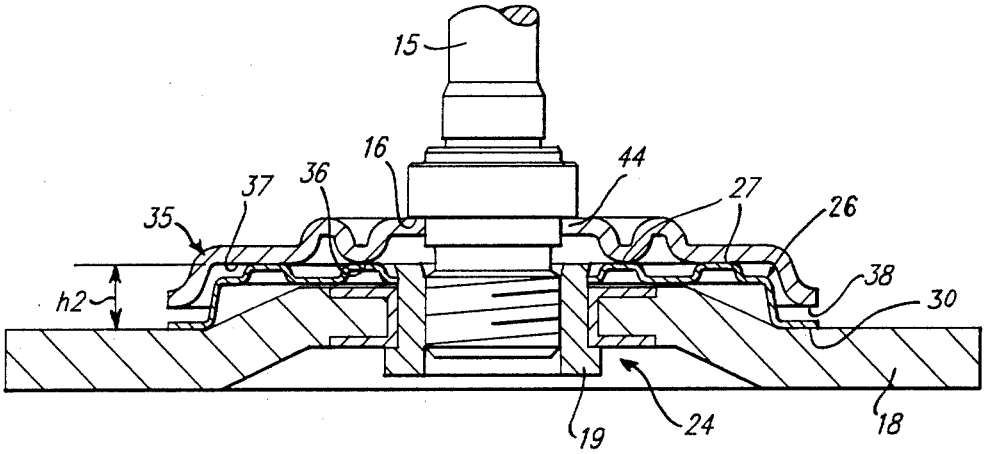
FIG. 5 is an elevational sectional detail view of the right-angle spindle of the tool shown in FIG. 1, showing a mounting and drive assembly according to the present invention when used with the abrasive disc subassembly illustrated in FIG. 3.

Referring now to FIG. 5, the use of the coupling flange member 35 according to the present invention in combination with the hubbed-type abrasive disc subassembly 24 illustrated in FIG. 3 as shown. The coupling flange member 35 is installed onto the spindle 15 so that the central contact surface 44 of the flange abuts the annular shoulder 16 of the spindle 15 in the same manner as that shown in FIG. 4. However, the coupling flange 35 is so configured that in this application the drive surfaces 36 and 37 radially align with and hence drivingly engage the corresponding radially spaced raised contact surfaces 27 on the backing flange 26 of the abrasive disc subassembly 24. The distal end drive surface 38 of the coupling flange member 35 remains spaced from and out of engagement with the abrasive disc subassembly 24 in this application. This is due to the fact that the aforesaid distance "h1" in the axial direction between drive surfaces 36, 37, and 38 of flange member 35 is less than the distance "h2" in the axial direction between contact surface 27 and distal end drive surface 30 of backing flange 26. Thus, the rotational force of the spindle 15 is transferred to the coupling flange 35 by virtue of the frictional interface between the coupling flange 35 and the annular shoulder 16 of the spindle 15, and then applied to the abrasive disc subassembly 24 via the frictional interface between the drive surfaces 36 and 37 on the coupling flange 35 and the contact surfaces 27 on the backing flange 26. It will be noted, however, that due to the similar radial locations of the drive surfaces 36 and 37 on the present coupling flange member 35 and the corresponding drive surfaces 29 on the base flange member 28 illustrated in FIG. 3, the previously described self-tightening feature of the two-component mounting system illustrated in FIG. 3 is retained by the present invention.

At this point, it is further significant to note that the distal end portion of the flange member 35 according to the present invention projects downward at a much steeper angle relative to the horizontal than does the distal end portion 22 of the prior art flange member 20 illustrated in FIG. 2. Specifically, whereas the distal end portion 22 of the flange member 20 shown in FIG. 2 projects downward at an angle of approximately 35°, the distal end portion of the present flange member 35 projects downward at an angle of approximately 75° (FIG. 4). This insures that the distal end portion of the present flange member 35 will clear the backing flange 26 when used with a hubbed wheel subassembly 24 (FIG. 5) without projecting radially outward a greater distance than that of a conventional flange member 20 (FIG. 2). In other words, the overall diameter of the flange member 35 of the present invention is essentially equivalent to that of the prior art flange member 20. Since grinding wheels are worn away from their outer radial periphery inward as they are used, it can be appreciated that it is desirable that the drive system not unnecessarily comprise the usable amount of area on the grinding wheel. Accordingly, it can be seen that the usable amount of the grinding wheel is not reduced by the present invention.

Figure 6:
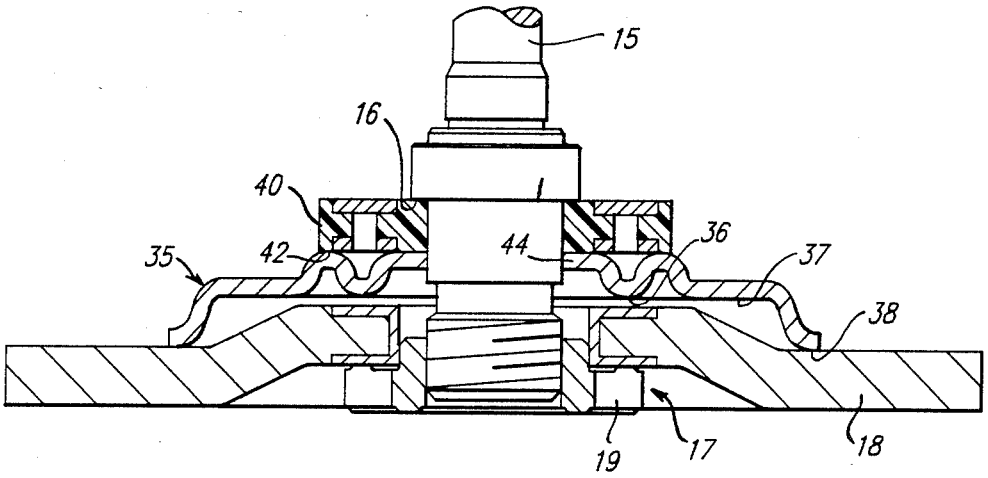
FIG. 6 is an elevational sectional detail view of the right-angle spindle of the tool shown in FIG. 1, showing an alternative mounting and drive assembly according to the present invention when used with the abrasive disc subassembly illustrated in FIG. 2.
Figure 7:
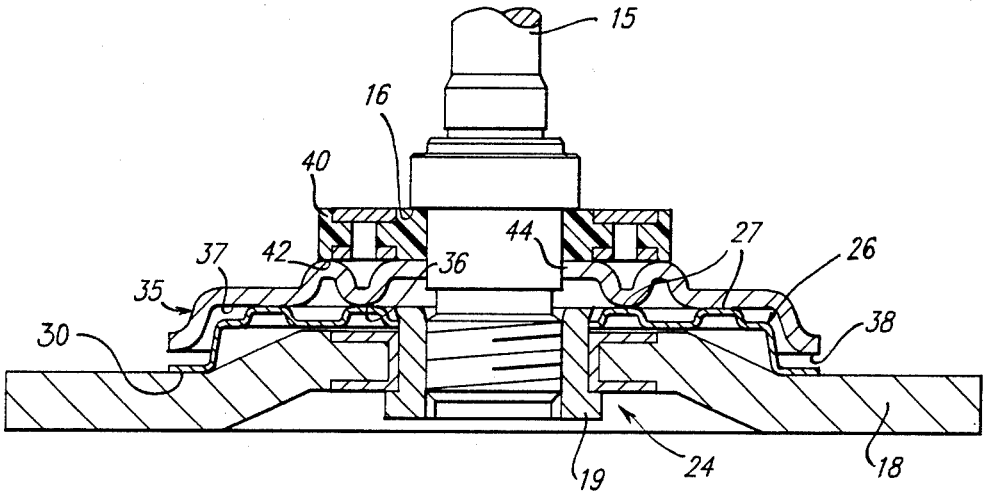
FIG. 7 is an elevational sectional detail view of the right-angle spindle of the tool shown in FIG. 1, showing the alternative mounting and drive assembly according to the present invention when used with the abrasive disc subassembly illustrated in FIG. 3.

Referring now to FIGS. 6 and 7, a further application of the coupling flange member 35 according to the present invention in combination with a "soft" washer assembly, for both the hubbed and unhubbed type wheel subassemblies are shown. In this application, an annular composite washer assembly 40 of the type illustrated and described in the aforementioned U.S. Pat. No. 4,449,329, entitled "Composite Washer Assembly", is installed on the spindle 15 against the annular shoulder 16 of the spindle 15. The coupling flange member 35 according to the present invention is then installed onto the spindle 15 against the bottom surface of the composite washer assembly 40. The present coupling flange member 35 is configured to provide a second annular contact surface 42 radially spaced from, and on the same axial plane as, the central contact surface 44, so that both contact surfaces 42 and 44 frictionally engage the washer assembly 40. This construction serves to improve the torque transfer characteristics between the spindle 15, washer assembly 40, and coupling flange 35.

While the above specification describes the preferred embodiments, it is understood that the present invention is subject to modification and change without departing from the proper scope or fair meaning of the accompanying claims.

What is claimed is:

1. For use with an abrading tool, a polishing tool, or other power tool of the type having a motor-driven spindle and a tool element subassembly comprised either of a first type including a generally planar tool element and a collar for threadably fastening the tool element to the spindle or a second type further including a hub or backing flange, having a pair of raised radially-spaced annular contact surfaces, that is adapted to be attached to the tool element for supporting the backside of the tool element; coupling means including a coupling flange for drivingly coupling either of said first or said second types of tool element subassemblies to the spindle of the power tool, comprising a first portion adapted to be coupled to the spindle so that said coupling flange is rotated by the spindle, a first drive surface adapted to drivingly engage the backside of the tool element of said first type of tool element subassembly when installed on the spindle, and second and third radially-spaced drive surfaces adapted to drivingly engage said pair of annular contact surfaces on said hub or backing flange of said second type of tool element subassembly when installed on the spindle.

2. The apparatus of claim 1 wherein said second and third drive surfaces do not contact said first type of tool element subassembly when installed on the spindle and said first drive surface does not contact said second type of tool element subassembly when installed on the spindle.

3. The apparatus of claim 2 wherein said first drive surface of said coupling flange is located at the outer distal end of said coupling flange.

4. The apparatus of claim 3 wherein said first drive surface is axially displaced relative to said second and third drive surfaces of said cuopling flange.

5. The apparatus of claim 1 wherein said spindle is provided with an annular shoulder and said coupling means further includes a washer installed on the spindle between the annular shoulder of the spindle and said coupling flange.

6. For use with an abrading tool having a motor-driven spindle provided with an annular shoulder and an abrasive disc subassembly comprising either a first type including a center depressed abrasive disc and a collar for threadably fastening the abrasive disc onto the spindle in the rotary direction opposite to the direction of spindle rotation or a second type further including a backing flange adapted to be attached to the backside of the abrasive disc and having a raised pair of radially-spaced annular contact surfaces and an outer distal end portion frictionally engaged with the backside of the abrasive disc; coupling means including a coupling flange for drivingly coupling either of said first or said second types of abrasive disc subassemblies to the spindle of the abrading tool, comprising a first portion adapted to frictionally engage the annular shoulder of the spindle, first and second annular drive surfaces adapted to frictionally engage said pair of raised annular contact surfaces on said backing flange of said second type of abrasive disc subassembly when installed on the spindle of the abrading tool, and a third annular drive surface at the outer distal end of said coupling flange axially disposed relative to said first and second drive surfaces and adapted to frictionally engage the backside of the abrasive disc of said first type of abrasive disc subassembly when installed on the spindle of the abrading tool.

7. The apparatus of claim 6 wherein said first and second drive surfaces of said coupling flange are adapted to frictionally engage the backside of the abrasive disc of said second type of abrasive disc subassembly at a location radially beyond the depressed center portion of the abrasive disc.

8. The apparatus of claim 7 wherein the displacement in the axial direction between said second and third drive surfaces of said coupling flange is greater than the axial displacement of the depressed center portion of the abrasive disc relative to the remainder of the abrasive disc in said first type of abrasive disc subassembly.

9. The apparatus of claim 8 wherein the displacement in the axial direction between said second and third drive surfaces of said coupling flange is less than the axial dimension from said pair of raised contact surfaces on said backing flange to the backside of the abrasive disc radially beyond the depressed center portion of the abrasive disc in said second type of abrasive disc subassembly.

10. The apparatus of claim 6 wherein said coupling means further includes a washer installed on the spindle between the annular shoulder of the spindle and said coupling flange so that said first portion of said coupling flange frictionally engages said washer.

11. The apparatus of claim 10 wherein said coupling flange further includes a second portion radially located between said first and second annular drive surfaces for frictionally engaging said washer.

12. A portable power tool comprising a housing, a motor installed within the housing, and an output spindle coupled to the motor for being driven thereby; the improvement comprising:

a drive system for drivingly coupling to the output spindle a tool element subassembly comprised either of a first type including a generally planar tool element and a collar for threadably fastening the tool element to the spindle or a second type further including a hub or backing flange, having a pair of raised radially-spaced annular contact surfaces, that is adapted to be attached to the tool element for supporting the backside of the tool element, said drive system including a coupling flange for drivingly coupling either of said first or said second types of tool element subassemblies to the spindle of the power tool, comprising a first portion adapted to be coupled to the spindle so that said coupling flange is rotated by the spindle, a first drive surface adapted to drivingly engage the backside of the tool element of said first type of tool element subassembly when installed on the spindle, and second and third radially-spaced drive surfaces adapted to drivingly engage said pair of annular contact surfaces on said hub or backing flange of said second type of tool element subassembly when installed on the spindle.

13. The portable power tool of claim 12 wherein said second and third surfaces do not contact said first type of tool element subassembly when installed on the spindle and said first drive surface does not contact said second type of tool subassembly when installed on the spindle.

14. The portable power tool of claim 13 wherein said first drive surface of said coupling flange is located at the outer distal end of said coupling flange.

15. The portable power tool of claim 14 wherein said first drive surface is axially displaced relative on said second and third drive surfaces of said coupling flange.

16. The portable power tool of claim 12 wherein said spindle is provided with an annular shoulder and further including a washer installed on the spindle between the annular shoulder of the spindle and said coupling flange.

17. A portable abrading tool comprising a housing, a motor installed within the housing, and an output spindle coupled to the motor for being driven thereby; the improvement comprising:

a drive system for drivingly coupling to the output spindle an abrasive disc subassembly comprising either a first type including a center depressed abrasive disc and a collar for threadably fastening the abrasive disc onto the spindle in the rotary direction opposite to the direction of spindle rotation or a second type further including a backing flange adapted to be attached to the backside of the abrasive disc and having a pair of raised radially-spaced annular contact surfaces and an outer distal end portion frictionally engaged with the backside of the abrasive disc, said drive system including a coupling flange for drivingly coupling either of said first or said second types of abrasive disc subassemblies to the spindle of the grinder, comprising a first portion adapted to frictionally engage the annular shoulder of the spindle, first and second annular drive surfaces adapted to frictionally engage said pair of raised annular contact surfaces on said backing flange of said second type of abrasive disc subassembly when installed on the spindle of the grinder, and a third annular drive surface at the outer distal end of said coupling flange axially displaced relative to said first and second drive surfaces and adapted to frictionally engage the backside of the abrasive disc of said first type of abrasive disc subassembly when installed on the spindle of the grinder.

18. The portable abrading tool of claim 17 wherein said first and second drive surfaces of said coupling flange are adapted to frictionally engage the backside of the abrasive disc of said second type of abrasive disc subassembly at a location radially beyond the depressed center portion of the abrasive disc.

19. The portable abrading tool of claim 18 wherein the displacement in the axial direction between said second and third drive surfaces of said coupling flange is greater than the axial displacement of the depressed center portion of the abrasive disc relative to the remainder of the abrasive disc.

20. The portable abrading tool of claim 19 wherein the displacement in the axial direction between said second and third drive surfaces of said coupling flange is less than the axial dimension from said pair of raised contact surfaces on said backing flange to the backside of the abrasive disc radially beyond the depressed center portion of the abrasive disc in said second type of abrasive disc subassembly.

21. The portable abrading tool of claim 17 further including a washer installed on the spindle between the annular shoulder of the spindle and said coupling flange so that said first portion of said coupling flange frictionally engages said washer.

22. The portable abrading tool of claim 21 wherein said coupling flange further includes a second portion radially located between said first and second annular drive surfaces for frictionally engaging said washer.

* * * * *

UNITED STATES PATENT AND TRADEMARK OFFICE

CERTIFICATE OF CORRECTION

PATENT NO. : 4,794,737

DATED : January 3, 1989

INVENTOR(S) : Russell M. Timmons et al.

It is certified that error appears in the above-identified patent and that said Letters Patent is hereby corrected as shown below:

Column 2, line 17, "froma" should be --from a--.

Column 4, line 45, "flange" should be --disc--.

Column 6, line 42, claim 4, "cuopling" should be --coupling--.

Column 7, line 2, claim 6, "disposed" should be --displaced--.

Column 7, line 67, claim 13, insert "element" after --tool--.

Signed and Sealed this

First Day of August, 1989

*Attest:*

*Attesting Officer*

DONALD J. QUIGG

*Commissioner of Patents and Trademarks*